US006382185B1

(12) United States Patent
Mennicken et al.

(10) Patent No.: US 6,382,185 B1
(45) Date of Patent: May 7, 2002

(54) FUEL INJECTION VALVE

(75) Inventors: Michael Mennicken, Heimsheim; Ralf Wirth, Leonberg; Peter Boehland, Steinheim; Christoph Badock, Bamberg; Ralf Hentschel, Munich, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,677

(22) PCT Filed: Dec. 8, 1999

(86) PCT No.: PCT/DE99/03914

§ 371 Date: Aug. 22, 2000

§ 102(e) Date: Aug. 22, 2000

(87) PCT Pub. No.: WO00/37794

PCT Pub. Date: Jun. 29, 2000

(30) Foreign Application Priority Data

Dec. 22, 1998 (DE) ..... 198 59 592

(51) Int. Cl.[7] ..... F02M 37/04

(52) U.S. Cl. ..... 123/467; 123/501

(58) Field of Search ..... 123/467, 458, 123/446, 500, 501

(56) References Cited

U.S. PATENT DOCUMENTS

| | | | | | |
|---|---|---|---|---|---|
| 4,976,245 | A | * | 12/1990 | Takahashi et al. | 123/506 |
| 4,989,571 | A | * | 2/1991 | Guentert et al. | 123/495 |
| 5,381,999 | A | * | 1/1995 | Ricco | 251/129.16 |
| 5,467,757 | A | * | 11/1995 | Yanagihara et al. | 123/305 |
| 5,699,770 | A | * | 12/1997 | Matsumoto et al. | 123/470 |
| 5,832,899 | A | * | 11/1998 | Soteriou | 123/456 |
| 5,862,793 | A | * | 1/1999 | Jay et al. | 123/467 |
| 5,890,471 | A | * | 4/1999 | Nishimura | 123/496 |

* cited by examiner

*Primary Examiner*—Carl S. Miller
(74) *Attorney, Agent, or Firm*—Ronald E. Greigg

(57) ABSTRACT

A fuel injection valve for a high-pressure injection of fuel from a central high-pressure reservoir into combustion chambers of an internal combustion engine, wherein, by means of an inlet throttle bore, the high-pressure reservoir is operationally connected to a control chamber which controls the opening and closing of the fuel injector, and wherein the control chamber communicates with an on-off valve by means of an outlet throttle bore. The inlet throttle bore is aligned eccentrically in relation to the control chamber.

5 Claims, 1 Drawing Sheet

FUEL INJECTION VALVE

BACKGROUND OF THE INVENTION

1. Field of the Invention

This invention relates to a fuel injection valve in particular for high-pressure injection of fuel into combustion chambers of internal combustion engines.

2. Description of the Prior Art

In fuel injected internal combustion engines, the fuel is injected from a high-pressure chamber into the combustion chamber by means of a fuel injector in order to produce a mixture. In common rail injection systems, the servo principal among others is used to open and close the injection valves. The injection valve 40 is part of a servo valve. An electrically triggered on-off valve controls a volume flow. By means of a pressure divider, which is comprised of two through flow resistors, an open on-off valve produces an opening motion of the servo valve. A closed on-off valve produces a closing motion of the servo valve.

In order to achieve an optimal combustion process in the combustion chamber, it is necessary to control the time, the duration of injection, the total fuel quantity injected, and the chronological course of the injection rate as precisely as possible since the combustion chamber geometry is precisely adapted to these parameters in order to minimize fuel consumption and exhaust emissions.

The object of the current invention, therefore, is to produce a fuel injection valve with a combination of an on-off valve and a servo-hydraulic valve in which there is a precisely defined through flow resistance of the on-off valve in the greatest possible range of different fuel pressures. Moreover, this through flow resistance must have the property that only a few geometric parameters influence its magnitude. The precisely defined through flow resistance of the on-off valve thereby determines the opening speed of the servo valve.

SUMMARY OF THE INVENTION

The fuel injection valve according to the present invention, has the advantage that the effective flow cross section of the opening produced by the on-off valve encourages the formation of a cavitating throttle flow. The eccentric position of the inlet throttle bore causes a rotation of the fuel flow in the control chamber. This rotation which, after the opening of the on-off valve, accelerates as it flows through the outlet throttle bore due to the conservation of momentum in the fuel flow, leads to a reduction of the static pressure in the fluid and thereby increases the cavitation tendency of the fluid as it flows through the outlet throttle bore. As a result of the spin-encumbered flow inside the outlet throttle bore, the cavitation tendency is extended to a wide pressure range. Even with slight pressure differences over the outlet throttle bore and with high pressures in the low-pressure region downstream of the outlet throttle bore, cavitation effects occur and result in the fact that the effective opening cross section, which is constituted by the combination of the solenoid valve 40 and outlet throttle bore 30, is only influenced by the geometry of the outlet throttle bore. As a result of this, an exactly defined through flow cross section can be established with the aid of the size of the outlet throttle bore, without having to take into account the influence of the solenoid valve 40.

According to a preferred embodiment, the inlet throttle bore is aligned tangential to the control chamber. This results in the fact that all regions of the flow in the control chamber are set into rotation.

According to another embodiment, with a cylindrically embodied control chamber, the rotation of the flow is not hindered by edges or corners. Preferably, the inlet throttle bore and the outlet throttle bore are disposed at right angles to each other. As a result, the rotation axis of the flow produced extends parallel to the influx direction of the fuel into the outlet throttle bore.

BRIEF DESCRIPTION OF THE DRAWINGS

The foregoing and other features and advantages of the invention will be apparent from the detailed description contained herein below taken; in conjunction with in which.

DETAILED DESCRIPTION OF THE PREFERRED EMBODIMENT

Figure 1:
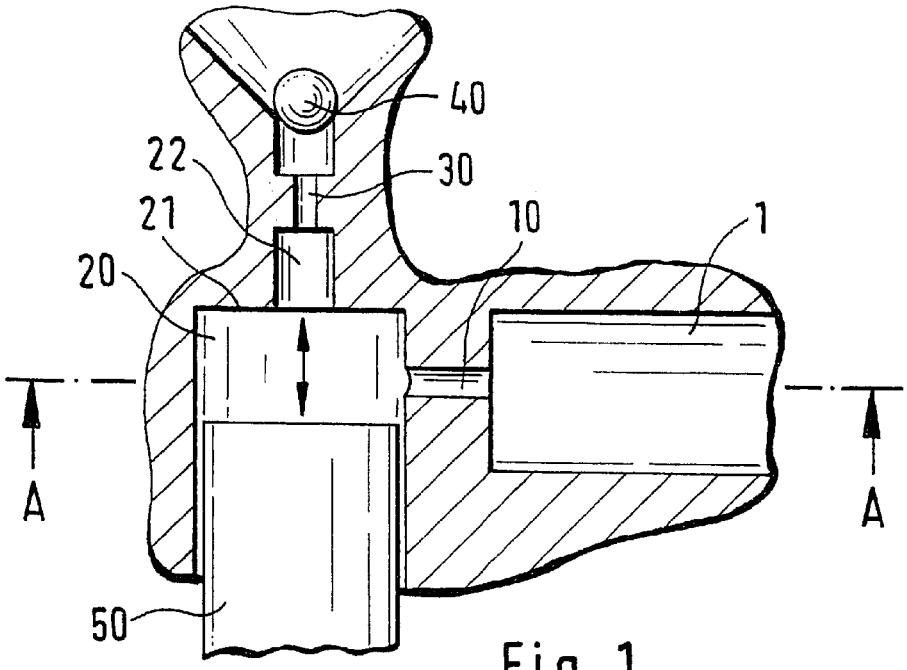
FIG. 1 shows a sectional view of an on-off valve in connection with an inlet throttle bore, a control chamber, and an outlet throttle bore.

FIG. 1 shows a sectional view through an on-off valve 40 that communicates with a control chamber 20 in which a piston 50 is movably disposed. The piston 50 is connected to the valve needle of the actual injection valve, not shown. The fuel flows from a central high-pressure line 1 to the control chamber 20 via an inlet throttle bore 10. An opening 22 is preferably disposed at the end 21 of the control chamber 20 and leads to an outlet throttle bore 30. This preferably results in a right-angled alignment of the axes of the inlet throttle bore 10 and the outlet throttle bore 30 in relation to each other.

The on-off valve 40, which opens or closes the outlet of the outlet throttle bore 30 depending on its switched position, is disposed on the side of the outlet throttle bore 30 remote from the control chamber 20. The fuel flows from the on-off valve 40 back into the low-pressure region of the fuel system.

The control piston 50 is disposed at the end of the control chamber 20 opposite from the end 21 and is connected to the nozzle needle of the actual injection valve. Movements of the control piston 50 correspond to movements of the valve needle of the actual injection valve, which separates the combustion chamber from the high-pressure region 1 of the fuel injection system. Movements of this control piston 50 (indicated by the double arrow in FIG. 1) lead to an opening or closing of the fuel supply into the combustion chamber. The on-off valve 40 is electrically triggered.

Figure 2:
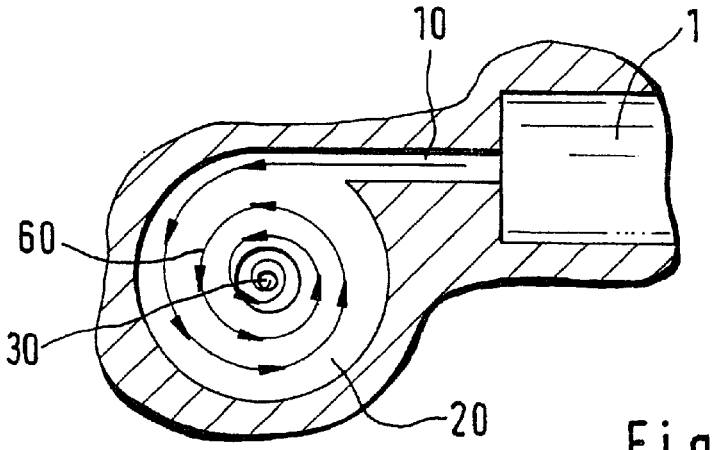
FIG. 2 shows a sectional view along the line A—A in FIG. 1, which schematically depicts the rotation of the flow in the control chamber.

With reference to FIG. 2, the inlet throttle bore 10 is disposed eccentrically in relation to the control chamber 20. The control chamber 20 is preferably cylindrical in shape, i.e. the cross section, which is shown in FIG. 2 and extends along the dot-and-dash line A—A in FIG. 1, is circular. Preferably the orientation of the longitudinal axis of the inlet throttle bore 10 corresponds to a tangent to the circle that is formed by the cross section of the control chamber 20.

When the fuel flows into the control chamber 20, the eccentric orientation of the inlet throttle bore 10 produces a swirling flow 60 whose flow lines are schematically indicated in FIG. 2 by means of arrows. With the preferred tangential disposition of the inlet throttle bore 10, the swirling flow 60 encompasses the entire cross-sectional area of the control chamber 20.

If the on-off valve 40 is open, this swirling flow 60 enters the opening of the outlet throttle bore 30 which has a significantly smaller cross-sectional area than the control chamber 20. Due to conservation of momentum, as the fluid flows out through the outlet throttle bore 30, the rotation speed of the swirling flow 60 increases so that the static pressure in the flow decreases sharply. This increases the tendency of the flow to cavitate in the vicinity of the outlet throttle bore 30. The onset of cavitation effects results in the fact that the overall through flow resistance of the combination of the outlet throttle 30 and on-off valve 40 depends solely on the through flow resistance of the outlet throttle 30. This makes it easier to adjust the magnitude of the outgoing volume flow. Since the movement speed of the piston 50 depends directly on the outgoing volume flow, an increase in the precision of the movement speed of the piston 50 occurs due to the increase in the cavitation tendency of the flow in the outlet throttle bore 30. Since the movement speed of the piston 50 corresponds to the movement speed of the valve needle of the injection valve, the movement precision of the injection valve also consequently increases as does the precision of the fuel quantity injected. This means that the movement speed of the valve needle of the injection valve, which should occur in as uniform a manner as possible, can be intentionally adjusted by means of the dimensioning and/or embodiment of the outlet throttle bore 30 and can be optimized with regard to the injection conditions.

The foregoing relates to preferred exemplary embodiments of the invention, it being understood that other variants and embodiments thereof are possible within the spirit and scope of the invention, the latter being defined by the appended claims.

We claim:

1. In a fuel injection valve for a high-pressure injection of fuel from a central high-pressure reservoir (1) into combustion chambers of an internal combustion engine, wherein an inlet throttle bore (10), operationally connects the high-pressure reservoir (1) to a control chamber (20) which controls the opening and closing of the fuel injector, and wherein the control chamber (20) communicates with an on-off valve (40) by means of an outlet throttle bore (30), the improvement wherein the inlet throttle bore (10) is aligned eccentrically in relation to the control chamber (20), and wherein the inlet throttle bore (10) is aligned tangentially in relation to the control chamber (20), and wherein the inlet throttle bore (10) and the outlet throttle bore (30) are disposed perpendicular to each other.

2. The fuel injection valve according to claim 1, wherein the control chamber (20) is cylindrical in shape.

3. The fuel injection valve according to claim 2, wherein the outlet throttle bore (30) is dimensioned so that when the on-off valve (40) is actuated, cavitation effects occur in the outlet throttle bore (30).

4. In a fuel injection valve for a high-pressure injection of fuel from a central high-pressure reservoir (1) into combustion chambers of an internal combustion engine; wherein an inlet throttle bore (10), operationally connects the high-pressure reservoir (1) to a control chamber (20) which controls the opening and closing of the fuel injector, and wherein the control chamber (20) is generally cylindrically shaped, and communicates with an on-off valve (40) by means of an outlet throttle bore (30), the improvement wherein the inlet throttle bore (10) is aligned eccentrically in relation to the cylindrical axis of the control chamber (20) and perpendicular to said axis.

5. The fuel injection valve according to claim 4, wherein the inlet throttle bore (10) is aligned tangentially in relation to a circular section of the control chamber (20).

* * * * *

UNITED STATES PATENT AND TRADEMARK OFFICE

CERTIFICATE OF CORRECTION

PATENT NO. : 6,382,185 B1
DATED : May 7, 2002
INVENTOR(S) : Michael Mennicken et al.

It is certified that error appears in the above-identified patent and that said Letters Patent is hereby corrected as shown below:

Title page,
Item [86], should read as follows:

-- [86] PCT No.: PCT/DE 99/03914
371 Date: November 3, 2000
102(e) Date: November 3, 2000 --

Signed and Sealed this

Third Day of September, 2002

*Attest:*

*Attesting Officer*

JAMES E. ROGAN
*Director of the United States Patent and Trademark Office*